United States Patent [19]

Knoll

[11] 4,353,009

[45] Oct. 5, 1982

[54] DIMMING CIRCUIT FOR AN ELECTRONIC BALLAST

[75] Inventor: William C. Knoll, Turbotville, Pa.

[73] Assignee: GTE Products Corporation, Stamford, Conn.

[21] Appl. No.: 218,311

[22] Filed: Dec. 19, 1980

[51] Int. Cl.[3] ..... H05B 41/29

[52] U.S. Cl. ..... 315/220; 315/105; 315/224; 315/277; 315/278; 315/291; 315/DIG. 4

[58] Field of Search ..... 315/105, 106, 209 R, 315/219, 220, 224, 277, 278, 291, DIG. 4, DIG. 7

[56] References Cited

U.S. PATENT DOCUMENTS 4,075,476 2/1978 Pitel ..... 315/278 X 4,188,661 2/1980 Bower et al. ..... 315/220 X

*Primary Examiner*—Eugene R. La Roche

*Attorney, Agent, or Firm*—John A. Odozynski

[57] ABSTRACT

A dimmer circuit for an inverter-driven electronic ballast system. The ballast includes an output transformer having a primary winding coupled to the inverter output and a secondary winding adapted to be coupled to a lamp filament winding for supplying power to the filament. An interstage transformer has a primary winding adapted to be coupled to a lamp filament and a secondary winding coupled to an inverter input for applying a feedback signal derived from the filament current at that input. The dimmer circuit is in the form of a feedback loop that includes a winding on the primary of the output transformer, a winding on the primary of the interstage transformer, and a variable impedance coupling those windings. Varying the impedance necessarily varies the total feedback loop impedance and therefore the amount of feedback applied at the inverter output and, inversely, the power supplied to the lamp filament.

9 Claims, 2 Drawing Figures

T1
T2
T3
W11
W12
W13
W14
W15
W21
W22
W23
W24
W31
W32
L1
L2
C1
C2
C3
C4
C5
R1
R2
R3
R4
R5
R6
R7
D1
D2
D3
D4
D5
Q1
Q2
V0
Vx
1
2
3
4
5
6
8
51
52
61
62
71
72
73
74
LINE
LINE COND.
POWER SOURCE

DIMMING CIRCUIT FOR AN ELECTRONIC BALLAST

CROSS REFERENCE TO RELATED APPLICATIONS

Cross reference is made to the following applications, all assigned to the same assignee and filed on the same date as this application:

"Improved Output Configuration for Electronic Ballast", by William C. Knoll, Ser. No. 218,387 filed Dec. 19, 1980;

"Improved Transistor Drive Scheme for Fluorescent Lamp Ballast", by William C. Knoll and David LaRue Bay, Ser. No. 218,388, filed Dec. 19, 1980; and "Direct Drive Ballast with Delayed Starting Circuit", by William C. Knoll and David LaRue Bay, Ser. No. 218,386, filed Dec. 19, 1980.

TECHNICAL FIELD

This invention relates to electronic ballast circuitry and more particularly to a dimming circuit that may be controlled via a remote, low-level signal.

BACKGROUND ART

U.S. Pat. No. 4,188,661, "Direct Drive Ballast With Starting Circuit" by Bruce L. Bower and Raymond H. Kohler, assigned to the assignee of the present invention, describes an electronic ballast circuit for driving a pair of fluorescent lamps. Central to the operation of that circuit is a high frequency (20 to 30 KHz) inverter comprising two transistors connected in series and operating in a push-pull mode. The inverter drives, via an output transformer, the cathode filaments of the lamps. The output transformer comprises a series-resonant primary winding coupled to the inverter output. The secondary of the output transformer includes one lamp voltage winding, three filament windings, two for separately supplying current to one filament of each of the lamps. The third filament winding supplies current to the remaining two, parallel-connected filaments. Also included on the secondary of the output transformer is a series connected discrete ballasting inductor in series with a pair of drive windings oppositely poled and connected in series between the first and second filament windings. These windings are arranged so as to establish a voltage differential across the cathodes of the respective lamps sufficient to effect firing of the lamps.

The ballast circuit further includes an interstage transformer having three primary windings each coupled in a loop that includes at least one lamp filament and a lamp filament winding. The secondary of the interstage transformer includes a pair of oppositely-poled windings coupled to the push-pull inputs of the inverter. Because the primary windings are coupled in a loop that includes the lamp filaments, they induce a voltage in the secondary proportional to the sum of filament currents. Proper phasing of the secondary windings provides the positive feedback necessary to sustain inverter operation. (A modified feedback arrangement disclosing a single primary winding connected in a loop with the two parallel-connected filaments is disclosed in U.S. Pat. No. 4,127,893, "Tuned Oscillator Ballast Circuit With Transient Compensating Means" by Charles A. Goepel and assigned to the assignee of the present inventions. See FIG. 2 of that patent).

U.S. Pat. No. 4,188,661 also discloses circuitry for enhancing the oscillator startup operation. Upon initial energization of the ballast circuit, a capacitor connected in parallel with one of the secondaries of the interstage transformer is slowly charged through a source of rapidly developed DC voltage. When the charge across the capacitor reaches a given magnitude, a series connected diac is switched on thereby discharging the capacitor through a relatively low impedance and causing a transient across the primary of the interstage transformer. This perturbation supplies base drive to at least one of the inverter transistors and assures oscillator startup. A voltage derived from the current in the primary of the output is rectified and applied to the diac in a manner that renders the diac nonconducting during steady state operation of the ballast circuit.

While it cannot be gainsaid that the circuitry disclosed in the patent discussed above represents a substantial advance in the state of the art of ballast design, with regard to both the conventional electromagnetic and the electronic types, the subject invention represents a further substantial advance in that art. In particular, it provides an efficient and effective circuit for dimming fluorescent lamps, thereby allowing control of the desired level of light delivered and minimizing the amount of electrical energy consumed.

DISCLOSURE OF THE INVENTION

The above and other objects and advantages are achieved in one aspect of this invention by a dimmer circuit for an electronic ballast system that includes an interstage transformer having a primary winding adapted to be coupled to a lamp filament and a secondary winding coupled to an input of an inverter for supplying a feedback signal to the inverter. The ballast system also includes an output transformer having a primary winding coupled to an output of the inverter and a secondary winding adapted to be coupled to a lamp filament for supplying current to the filament. The dimmer is in the form of a feedback circuit loop that includes a first winding on the primary of the interstage transformer and a second winding on the primary of the output transformer. In addition, means coupling those windings varies the amount of feedback applied at the inverter input and therefore the amount of power supplied to the lamp filament. In another aspect of this invention the dimmer feedback circuit loop also includes an impedance that provides the phase shift required to effect optimal switching of push-pull transistors in the inverter circuit.

The subject invention represents a novel technique for providing high efficiency dimming for fluorescent as well as other types of lamps. In addition, a specific embodiment of the dimmer feedback loop is readily amenable to both manual or automatic dimming control from a remote location, via, for example, a potentiometer or computer.

DESCRIPTION OF THE PREFERRED EMBODIMENT

Figures 1, 2:
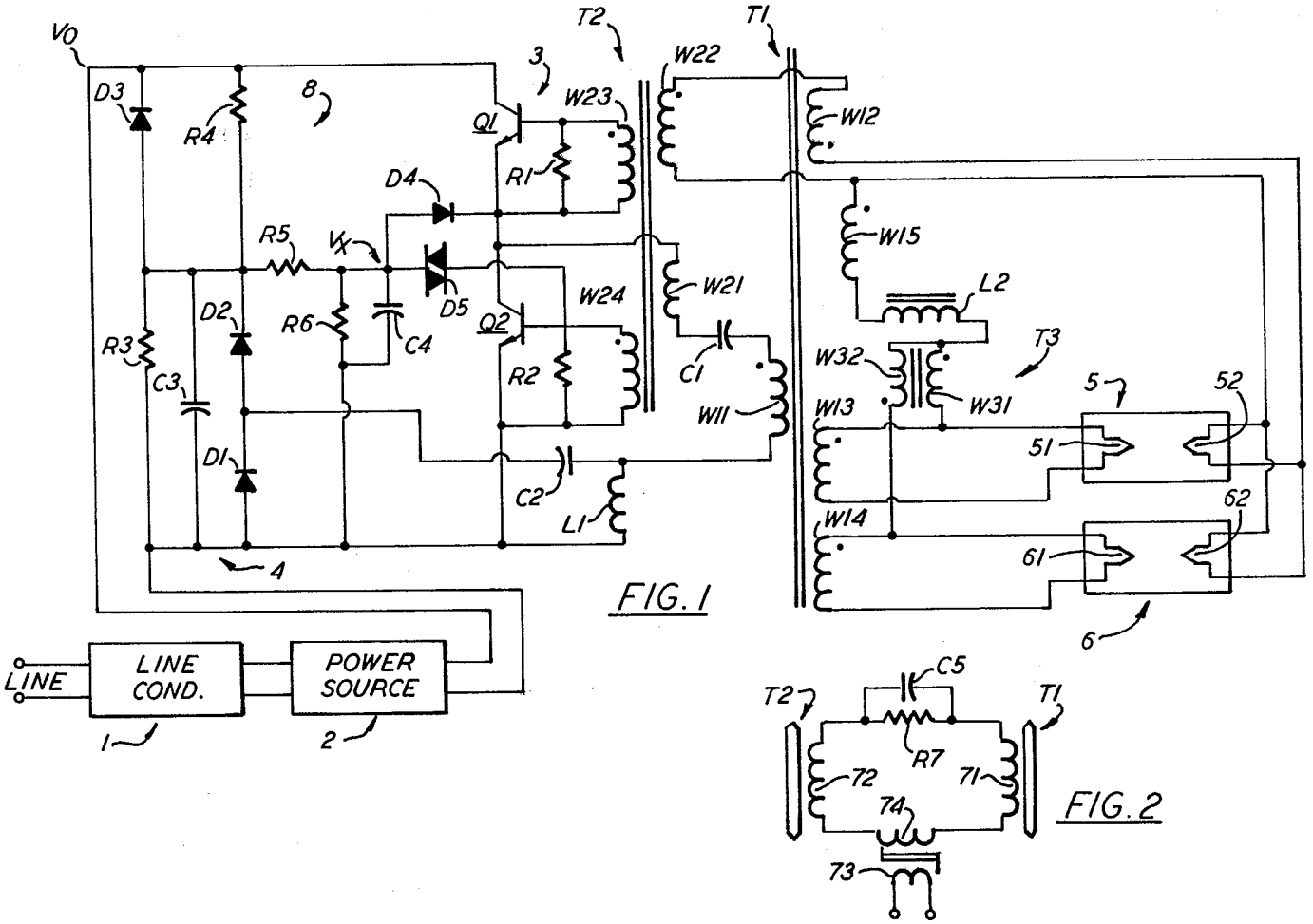
FIG. 1 is a schematic diagram of an electronic ballast system as described in the patent applications cited above.
FIG. 2 is a schematic diagram of a dimming circuit suitable for incorporation in that ballast system.

For a better understanding of the present invention, together with the objects, advantages and capabilities thereof, refer to the following disclosure and appended claims in conjunction with the accompanying drawings.

Referring now to FIG. 1, the electronic ballast circuit derives its primary power from the AC line through a line conditioner 1. The line conditioner may include, inter alia, a transient suppressor, overload switch and line filter. See, e.g. U.S. Pat. No. 4,188,661, supra, at column 2, lines 38–48, column 3, lines 36–52, and as illustrated in the drawing as element 5. The output of the line conditioner is coupled to the input of a voltage supply 2 which provides a nominal output voltage of 300 volts.

The core of the electronic ballast system illustrated in FIG. 1 is the high frequency, push-pull inverter 3 comprising NPN transistors Q1 snd Q2. Q1 has a collector connected to the high side of the voltage supply and an emitter connected to the collector of Q2; the emitter of Q2 is in turn connected to the common or ground return of the voltage supply. The base-to-emitter junctions of both Q1 and Q2 are individually coupled by damping resistors, R1 and R2, respectively. The output of inverter 3, that is, the signal at the junction of Q1 emitter and Q2 collector, is coupled through a capacitor C1 to one side of the primary winding, W11, of output transformer T1. A detailed discussion of the construction and operation of T2 is presented below. In a preferred embodiment the output of the inverter is coupled to W11 through a network that includes the series connection of C1 and a winding W21 of interstage transformer T2. The other side of W11 is coupled to the input of what, for present purposes, will be considered a secondary voltage source 4.

Voltage source 4 includes an inductance L1 connected between W11 and the common return. The junction of W11 and L1 is coupled through capacitor C2 to a voltage-doubling peak rectifier that includes diodes D1 and D2, capacitor C3, and resistor R3. D1 has a cathode connected to C2 and an anode connected to the common return. D2 has an anode connected to the cathode of D1 and a cathode connected to one side of C3; the other side of C3 is connected to the common return. R3 is connected in parallel with C3. The output of the secondary voltage source 4 is coupled through a diode D3, in the anode-to-cathode direction, to the high side of the primary voltage source 2.

Operation of voltage supply 4 is contingent on the operation of the inverter circuit in the following manner. When operating the inverter develops approximately a 20 KHz square wave at the junction of Q1 and Q2. (The frequency of the output signal is largely determined by the resonant frequency of C1 and W11, the effect of W21 being substantially negligible). The current flowing in W11 is coupled to the common return through L1, thereby developing a periodic voltage across L1 in proportion to that current. That voltage is coupled through C1 to rectifying diodes D1 and D2. In standard fashion the charge stored in C3 will represent a voltage substantially equal to the peak-to-peak voltage across L1, less losses attributable to the rectification process. Normally the voltage developed by the secondary source 4 will be less than that developed by the primary source 2 so that D3 will be reverse biased, the two sources isolated from each other, and negligible current drawn from the secondary source. However, under low-line or other aberrant conditions, the voltage at the output of source 2 may drop so significantly that D3 will become forward biased and the secondary source will then be available to power the inverter circuitry.

Startup of the oscillator is assured by a startup circuit 5 that includes a charging resistor (R4), a voltage divider resistors (R5 and R6), a clamping circuit (diode D4 and capacitor C4) and a semiconductor switch in the form of diac D5.

R5 is coupled from the high side or voltage source 1 to one side of C3 so that, subsequent to the energization of the ballast circuit, C3 begins to charge toward the voltage at the output of that source. (To be precise, it will take some time for output of source 2 to attain its nominal value but this duration can be expected to be de minimis in comparison with the R4C3 time constant). R5 and R6 are series connected across C3, so that the voltage developed at the junction of R5 and R6, ultimately coupled to D5, will track the exponentially-rising voltage across C3. As illustrated in FIG. 1, D5 has one end coupled to the output of the voltage divider, at the junction of R5 and R6, and the other end coupled to an input of the inverter, at the base of Q2. Neglecting the effect of R3, the voltage, $V_x$, at the output of the voltage divider will increase roughly as $$\frac{R6}{R5 + R6} \times V_o(1 - e - t/R4\ C3).$$

At some time determined by the values of the components represented in that relationship above, $V_x$ will exceed the breakover voltage of D5. D5 will fire, thereby supplying bias current to the base of Q2 and initiating operation of the inverter, after which the inverter will become self-sustaining. The salient advantage of this startup circuit is that startup of the inverter is inhibited until C3 of the secondary voltage source has become charged. As a result the inverter transistors are spared some deleterious effects attendent the initial current surge required to charge C3.

The startup circuit also includes a clamping circuit comprising D4, with a cathode connected to the inverter output, and an anode connected to the voltage divider output, and C4, connected from there to ground. The clamping action of D4 and C4 prevents the square wave from randomly firing D5. In effect, the clamping circuit disables the starting circuit during steady state inverter operations so that Q1 and Q2 are not subjected to transients that might result from the random firing of D5.

As illustrated in FIG. 1, the output of the inverter is coupled to T1 and drives a pair of fluorescent lamps, 5 and 6, having filaments 51 and 52 and 61 and 62, respectively. Filament current is supplied by filament windings W12, W13 and W14 on the secondary of the output transformer T1. Each of the filament windings is arranged to form a circuit loop with at least one filament of a lamp. W13 forms a loop with filament 51, W14 with filament 61, and W12 with the parallel-connected filaments 52 and 62. A drive winding, W15, on the secondary of T1 has a first end coupled to filaments 51 and 61. The drive winding establishes the necessary voltage differential across the filaments of lamps 5 and 6.

As illustrated in the drawing the drive winding W15 is coupled to filament windings 51 and 61 through an inductance L2 and a transformer T3. One end of L2 is connected to the second end of W15 and the other end is connected to the common terminal of T3. T3 includes first and second oppositely-poled windings, W31 and W32. W31 and W32 each have one end coupled to the common terminal of T3 and other ends respectively coupled to filaments 51 and 61.

T3 operates to enhance the firing of cold lamps. Assuming that one of the lamps fires initially, there will be a sudden increase in current through either lamp 5 or lamp 6, depending on whether lamp 5 or lamp 6 has fired. Assuming lamp 5 has fired the current surge in lamp 5, which must also flow through winding W31 of T3, will induce a voltage in winding W32. Because W31 and W32 are oppositely poled, the voltage induced in W32 will add to the voltage developed by drive winding W15, thereby assuring that lamp 6 will fire soon after lamp 5. Of course, the opposite would be true should lamp 6 fire before lamp 5.

L2, coupled between W15 and T3, is included to provide the proper series reactance for lamp ballasting.

The necessary feedback to sustain inverter oscillation is provided by interstage transformer T2. T2 includes a primary winding W22 and oppositely poled secondary windings W23 and W24. As shown in the drawing W22 is part of a circuit loop that includes filament winding W12 and parallel-connected filaments 52 and 62. Therefore, the current that flows through those filaments must necessarily flow through W22 as well. This signal is fed back to W23, coupled across the base-to-emitter junction of Q1, and W24, coupled across the base-to-emitter junction of Q2, in phase opposition (by virtue of polarity of those windings) so as to effect push-pull operation of the inverter.

As alluded to above, T2 also includes a winding W21 in series with the inverter's series resonant network, C1 and W11. W21, comprising approximately 5 to 10 turns, #26 wire, allows some relaxation of the switching parameter requirements of transistors Q1 and Q2. In particular, the switching speeds of transistor Q1 and Q2 need not be as closely matched as would be required in the absence of W21, and, therefore, less expensive transistors will be sufficient. This is because a small amount of the C1–W11 loop current is fed back to Q1 and Q2 as a function of the inverter operating frequency, thereby compensating for variations in the switching speeds of Q1 and Q2.

An additional embellishment in the electronic ballast system is comprised by a dimming circuit in the form of a feedback loop. (United States Patent Application Ser. No. 55,677, "Electronic Ballast Dimming Circuitry", filed July 9, 1979, now abandoned, by Gerald T. Smith and assigned to the assignee of this invention discloses an alternate method of achieving dimming control.) In substance dimming control is achieved therein by varying an inductance, corresponding to L1 in FIG. 1 of this application, in the secondary voltage supply). The dimming circuit includes a winding 72 (one thousand turns, #40 wire) on the primary of the base drive transformer, a winding 71 (one hundred turns, #38 wire) on the primary of the output transformer, an impedance in the form of a parallel-connected 4.7 K ohm resistor R7 and a 470 picofarad capacitor C5, and a variable inductance in the form of a saturable reactor. The saturable reactor is comprised of a control winding 73 wound on the center leg of a Ferrox cube 312, ¼" double E" core and an inductive winding 74 wound on the outer legs of the core. The control winding consists of four thousand turns, #40 wire. The inductive winding comprises 300 turns of #6 wound on each of the outer legs of the core.

The dimming function is effected in the following manner. Because of the coupling between winding W11 and winding 71, a feedback signal will be reduced in winding 71, the magnitude of which will be related to the magnitude of the inverter output signal. The feedback signal will be coupled to the input of the inverter through winding 72 and will have a phase relationship in opposition to the inverter drive signal. The resulting negative feedback effect will tend to reduce the inverter output signal and therefore to dim the fluorescent lamps, the greater the feedback, the greater the dimming effect.

Dimming control is achieved by varying the total impedance in the feedback loop. As the total impedance is decreased, the amount of feedback is increased and consequently the dimming effect as well. A converse effect occurs as the loop impedance is increased. The loop impedance may be varied by varying the inductance of the saturable reactor. As the current in the control winding is increased, the reactor core begins to saturate so that the inductance of winding 74 decreases; conversely as the control current is decreased, the inductance of winding 74 increases. For the configurations described above, a voltage of 0 to 5 volts applied across the control winding has been found to result in a current varying from 0 to 8 ma, sufficient to saturate the core. This variation in control current (or voltage) has been found to cause a four-to-one variation in ballast power, a satisfactory dimming effect. Because of the low control power required (less than 40 mw), this dimming technique is readily amenable to use with standard integrated circuit logic control modules and may be achieved either manually or automatically via, for example, a computer from remote locations. To summarize, as the control current in winding 73 is increased, the inductance of winding 74 is decreased, the total impedances in the feedback loop decreases, the negative feedback applied to the inverter is increased and the power delivered to the lamps decreases. R7 and C5 are included to provide the feedback loop phase shift necessary to insure "clean" switching of Q1 and Q2.

Accordingly, while there has been shown and described what at present is considered to be the preferred embodiment of an improved output configuration for an electronic ballast circuit, it will be obvious to those skilled in the art that various changes and modifications may be made therein without departing from the invention as defined by the appended claims.

INDUSTRIAL APPLICABILITY

This invention is useful in electronic ballast systems for fluorescent or other types of lamps.

What is claimed is:

1. In an electronic ballast circuit including an interstage transformer having a primary winding adapted to be coupled to a lamp filament and a secondary winding coupled to an input of an inverter, said interstage transformer for supplying a feedback signal to the inverter, and an output transformer having a primary winding coupled to an output of the inverter and a secondary winding adapted to be coupled to a lamp filament, said output transformer for supplying current to the lamp filament, a dimmer circuit in the form of a feedback loop comprising:

a first winding on the primary of the output transformer;

a second winding on the primary of the interstage transformer; and dimmer control means coupling the first and second windings for varying the impedance in the loop and therefore the amount of feedback applied to the inverter input and the amount of power supplied to the lamp filament.

2. A dimmer circuit as defined in claim 1 wherein the feedback loop further comprises impedance means for providing proper phase shift in the dimmer feedback loop and thereby optimal switching of the inverter.

3. A dimmer circuit as defined in either claim 1 or claim 2 wherein the dimmer control means comprises a saturable reactor.

4. In an inverter-driver electronic ballast system for supplying power to a lamp filament, said system including an interstage transformer having a primary winding adapted to be coupled to a lamp filament and a secondary winding coupled to an input of the inverter for applying at that input a feedback signal derived from the filament current, said ballast system also including an output transformer having a primary winding coupled to an output of the inverter and a secondary winding adapted to be coupled to a filament for supplying power to the filament, the improvement comprising a dimmer circuit in the form of a feedback loop that includes:

(a) a first winding on the primary of the interstage transformer;

(b) a second winding on the primary of the output transformer; and (c) dimmer control means coupling the first and second windings and for varying the impedance in the feedback loop and therefore the amount of feedback applied to the inverter input and the amount of power supplied to the lamp.

5. An improvement as defined in claim 4 wherein the feedback loop further includes an impedance for providing proper phase shift in the feedback loop and thereby optimal switching of the inverter.

6. An improvement as defined in either claim 4 or claim 5 wherein the dimmer control means comprises a variable inductance.

7. An improvement as defined in claim 6 wherein the variable inductance is a saturable reactor.

8. An improvement as defined in claim 7 wherein the saturable reactor includes a control winding adapted to receive a control current from a remote location, the control winding so arranged and constructed that the reactor inductance decreases as the control current increases and increases as the control current decreases.

9. An improvement as defined in claim 8 wherein the control winding is comprised of substantially 4000 turns of #40 wires so that full dimming of the lamp is provided by approximately 8 milliamperes of control current.

* * * * *